US009734842B2

(12) United States Patent
Le Magoarou et al.

(10) Patent No.: US 9,734,842 B2
(45) Date of Patent: Aug. 15, 2017

(54) METHOD FOR AUDIO SOURCE SEPARATION AND CORRESPONDING APPARATUS

(71) Applicant: THOMSON LICENSING, Issy les Moulineaux (FR)

(72) Inventors: Luc Le Magoarou, Rennes (FR); Alexey Ozerov, Rennes (FR); Quang Khanh Ngoc Duong, Rennes (FR)

(73) Assignee: THOMSON LICENSING, Issy-les-Moulineaux (FR)

( * ) Notice: Subject to any disclaimer, the term of this patent is extended or adjusted under 35 U.S.C. 154(b) by 0 days.

(21) Appl. No.: 14/896,382

(22) PCT Filed: Jun. 4, 2014

(86) PCT No.: PCT/EP2014/061576
§ 371 (c)(1),
(2) Date: Dec. 5, 2015

(87) PCT Pub. No.: WO2014/195359
PCT Pub. Date: Nov. 12, 2014

(65) Prior Publication Data

US 2016/0125893 A1 May 5, 2016

(30) Foreign Application Priority Data

Jun. 5, 2013 (EP) ..... 13305757

(51) Int. Cl.

| | |
|---|---|
| ***G10L 21/028*** | (2013.01) |
| ***G10L 21/0272*** | (2013.01) |
| ***G10L 13/10*** | (2013.01) |
| ***G10L 19/02*** | (2013.01) |
| ***G10L 19/038*** | (2013.01) |
| ***G10L 21/0232*** | (2013.01) |

(52) U.S. Cl.
CPC ..... *G10L 21/028* (2013.01); *G10L 13/10* (2013.01); *G10L 19/0212* (2013.01); *G10L 19/038* (2013.01); *G10L 21/0232* (2013.01); *G10L 21/0272* (2013.01)

(58) Field of Classification Search
None
See application file for complete search history.

(56) References Cited

U.S. PATENT DOCUMENTS 8,340,943 B2 * 12/2012 Kim ..... G10H 1/0008 381/98
8,563,842 B2 * 10/2013 Kim ..... G10H 1/0008 702/190
2010/0254539 A1 10/2010 Jeong et al.
(Continued)

OTHER PUBLICATIONS

Kim et al.; Nonnegative Matrix Partial Co-Factorization for Spectral and Temporal Drum Source Separation; IEEE Journal of Selected Topics in Signal Processing, vol. 5, No. 6, Oct. 2011; pp. 1192-1204.*

(Continued)

*Primary Examiner* — Abul Azad
(74) *Attorney, Agent, or Firm* — Tutunjian & Bitetto, P.C.

(57) ABSTRACT

Separation of speech and background from an audio mixture by using a speech example, generated from a source associated with a speech component in the audio mixture, to guide the separation process.

10 Claims, 7 Drawing Sheets

(56) References Cited

U.S. PATENT DOCUMENTS

2013/0132077 A1* 5/2013 Mysore ..... G10L 21/028 704/233
2015/0046156 A1* 2/2015 Coifman ..... G10L 21/0208 704/226

OTHER PUBLICATIONS

Sebastien Ewert etal: "using score-informed constraints for NMF-based source separation", 2012 IEEE international conference on acoustics, speech and signal processing (ICASSP 2012): Kyoto, Japan Mar. 25-30, 2012; [Proceedings], IEEE, Piscataway, NJ, Mar. 25, 2012, pp. 129-132, XP032227079, DOI: 10.1109/ICASSP.2012.6287834 ISBN: 978-1-4673-0045-2, p. 129, right-hand column, paragraph 2.—p. 131, left-hand column.
Derry Fitzgerald etal :"user assisted source separation using non negative matrix factorisation", 22nd IET Irish signals and systems conference, Jun. 23, 2011, pp. 1-6, XP05513298, Dublin, Ireland, Retrieved from the internet: URL: http://arrow.dit.ie/cgi/viewcontent.cgi?article=1064&context=argcon, [Retrieved on Jul. 31, 2014], p. 2, right-hand column, paragraph III—p. 4, left-hand column.
Minje Kim eta: "nonnegative matrix partial co facorization for spectral and temporal drum source separation", IEEE journal of selected topics in signal processing, IEEE, US, vol. 5, No. 6, Oct. 1, 2011, pp. 1192-1204, XP011386719, ISSN: 1932-4553, DOI: 10.1109/JSTSP.2011.2158803, p. 1196, left-hand column, line 1—p. 1199, right-hand column, line 1.
Luc Le Magoarou etal: "text informed audio source separation using nonnegative matrix partial co factorization", 2013 IEEE international workshop on machine learning for signal processing (MLSP), Sep. 1, 2013, pp. 1-6, XP055122931, DOI: 10.1109/MLSP.2013.6661995, ISBN: 978-1-47-991180-6, the whole document.
Smaragdis P etal: "separation by humming: user guided sound extraction from monophonic mixtures", applications of signal processing to audio and acoustics, 2009. WASPAA '09. IEEE workshop on, IEEE, Piscataway, NJ, USA Oct. 18, 2009, pp. 69-72, XP031575167, ISBN: 978-1-4244-3678-1, p. 70, left-hand column, paragraph 3.—p. 71, left-hand column.
Jiho Yoo etal: "nonnegative matrix partial co factorization for drum source separation", acoustics speech and signal processing (ICASSP), 2010 IEEE international conference on, IEEE, Piscataway, NJ, USA, Mar. 14, 2010, pp. 1942-1945, XP031697261, ISBN: 978-1-4244-4295-9, p. 1942, right-hand column, line 2—line 36, p. 1942, right-hand column, paragraph 2.—p. 1944, left-hand column, paragraph 3.
Demir etal: "Catalog based single channel speech music separation with the Itakura Saito divergence", 2012 20th european signal processing conference.
Grais etal: "Single channel speech music separation using nonnegative matrix factorization and spectral masks", 2011 17th international conference on digital signal processing (DSP 2011).
Joder etal : "Real time speech separation by semi supervised nonnegative matrix factorization", Proceedings 10th international conference, LVA/ICA 2012.
Weninger etal: "Supervised and semi supervised suppression of background music in monaural speech recordings", proceedings of the 2012 IEEE international conference on acoustics, speech and signal processing (ICASSP 2012).
Zheng etal: "Model based non negative matrix factorization for single channel speech separation", 2011 IEEE international conference on signal processing, commuinications and computing (ICSPCC).
Fevotte etal: "Nonnegative Matrix Factorization with Itakura Saito divergence", Neural Computation 2009.
Ganseman etal: "Source separation by score synthesis".
Lee etal: "Learning the parts of objects by nonnegative matrix factorization", Nature, pp. 788-791, 1999.
Lefevre etal: "Semi supervised NMF with time frequency annotations for single-channel source separation", International society for music information retrieval conference (ISMIR), 2012.
Ozerov etal: "A general flexible framework for the handling of prior information in audio source separation", IEEE transactions on audio, speech and lang, proc. vol. 20, n) 4, 99 1118-1133, 2012.
Pedone etal: "Phoneme level text to audio synchronization on speech signals with background music", In Audionamix, 2011.
Chen etal: "Low resource noise robust feature post processing on aurora 2_0", in proc. Int. conference on spoken language processing (ICSLP), 2002, pp. 2445-2448.
Durrieu etal: "Source filter model for unsupervised main melody Extraction From Polyphonic Audio Signals", IEEE transactions on audio, speech and language processing, vol. 18, No. 3, pp. 564-575, 2010.
Durrieu etal: "Musical audio source separation based on user selected F0 track", in Proc. Int. conf on latent variable analysis and signal separation (LVA/ICA), Tel Aviv, Israel, Mar. 2012, pp. 438-445.
Ellis: "Dynamic Time Warp in Matlab" 2003.
Emiya etal: "Subjective and objective quality assessment of audio source separation", IEEE transactions on audio speech and language processing, vol. 19, No. 7, pp. 2046-2057.
Fritsch etal: "Score informed audio source separation using constrained nonnegative matrix factorization and score synthesis", ICASSP 2013.
Fuentes etal: "Blind harmonic adaptive decomposition applied to supervised source separation", 20th european signal processing conference (EUSIPCO 2012), Bucharest, Romania, Aug. 27-31, 2012.
Hennequin etal: "Score informed audio source separation using a parametric model of non negative spectrogram", Proc. of IEEE International Conference on Acoustics, Speech, and Signal Processing (ICASSP), 2011, Prague, Czech Republic. 2011.
Kim etal: "Nonnegative matrix partial co factorization for spectral and temporal drum source separation", IEEE Journal of Selected Topics in Signal Processing, vol. 5, No. 6, Oct. 2011.
Mysore etal: "A Non negative Approach to Language Informed speech separation", in Proc. Int. Conference on Latent Variable, Analysis and Signal Separation (LVA/ICA), Tel Aviv, Israel, Mar. 2012.
Ozerov etal: "Multichannel Nonnegative tensor factorization with structured constraints for user-guided audio source separation", in Proc IEEE Int. Cont on acoustics, speech and signal processing (ICASSP) Prague, Czech Republic, May 2011.
Roweis: "One Microphone Source Separation", in Advances in neural inforamtion processing systems 13, 2000.
Simsekli etal: "Score guided musical source separation using generalized coupled tensor factorization", in 20th EUSIPCO 2012, Bucharest, Romania, Aug. 27-31, 2012.
Vincent etal: "Performance measurement in blind audio source separation", IEEE Transactions on Audio, Speech and Language Processing, Institute of Electrical and Electronics Engineers, 2006, 14 (4), pp. 1462-1469.
Vincent etal: "The signal separation evaluation campaign 2007_2010: achievements and remaining challenges",, Signal Processing, vol. 92, No. 8, pp. 1928-1936, 2012.
Virtanen etal: "Analysis of polyphonic audio using source filter model and non negative matrix factorization", in advances in models for acoustic processing, neural information processing sytems workshop, 2006.
Wang etal: "Video assisted speech source separation", ICASSP 2005, pp. 425-428.
Garofolo etal: "DARPA TIMIT acoustic phonetic continuous speech corpus", Tech. Rep. NIST, 1993, distributed with the TIMIT CD-ROM.

* cited by examiner

METHOD FOR AUDIO SOURCE SEPARATION AND CORRESPONDING APPARATUS

This application claims the benefit, under 35 U.S.C. §365 of International Application PCT/EP2014/061576, filed 4 Jun. 2014, which was published in accordance with PCT Article 21(2) on 11 Dec. 2014 under number WO2014/195359 in the English language and which claims the benefit of European patent application No. 13305757.0, filed 5 Jun. 2013.

1. FIELD

The present disclosure generally relates to audio source separation for a wide range of applications such as audio enhancement, speech recognition, robotics, and post-production.

2. TECHNICAL BACKGROUND

In a real world situation, audio signals such as speech are perceived against a background of other audio signals with different characteristics. While humans are able to listen and isolate individual speech in a complex acoustic mixture (known as the "cocktail party problem", where a number of people are talking simultaneously in a room (like at a cocktail party)) in order to follow one of several simultaneous discussions, audio source separation remains a challenging topic for machine implementation. Audio source separation, which aims to estimate individual sources in a target comprising a plurality of sources, is one of the emerging research topics due to its potential applications to audio signal processing, e.g., automatic music transcription and speech recognition. A practical usage scenario is the separation of speech from a mixture of background music and effects, such as in a film or TV soundtrack. According to prior art, such separation is guided by a 'guide sound', that is for example produced by a user humming a target sound marked for separation. Yet another prior art method proposes the use of a musical score to guide source separation of a music in audio mixture. According to the latter method, the musical score is synthesized, and then the synthesized musical score, i.e. the resulting audio signal is used as a guide source that relates to a source in the mixture. However, it would be desirable to be able to take into account other sources of information for generating the guide audio source, such as textual information about a speech source that appears in the mixture.

The present disclosure tries to alleviate some of the inconveniences of prior-art solutions.

3. SUMMARY

In the following, the wording 'audio signal', 'audio mix' or 'audio mixture' is used. The wording indicates a mixture comprising several audio sources, among which at least one speech component, mixed with the other audio sources. Though the wording 'audio' is used, the mixture can be any mixture comprising audio, such as a video mixed with audio.

The present disclosure aims at alleviating some of the inconveniences of prior art by taking into account auxiliary information such as text and/or a speech example) to guide the source separation.

To this end, the disclosure describes a method of audio source separation from an audio signal comprising a mix of a background component and a speech component, comprising a step of producing a speech example relating to a speech component in the audio signal; a step of estimating a first set of characteristics of the audio signal and of estimating a second set of characteristics of the produced speech example; and a step of obtaining an estimated speech component and an estimated background component of the audio signal by separation of the speech component from the audio signal through filtering of the audio signal using the first and the second set of estimated characteristics I.

According to a variant embodiment of the method of audio source separation, the speech example is produced by a speech synthesizer.

According to a variant embodiment of the method, the speech synthesizer receives as input subtitles that are related to the audio signal.

According to a variant embodiment of the method, the speech synthesizer receives as input at least a part of a movie script related to the audio signal.

According to a variant embodiment of the method of audio source separation, the method further comprises a step of dividing the audio signal and the speech example into blocks, each block representing a spectral characteristic of the audio signal and of the speech example.

According to a variant embodiment of the method of audio source separation, the characteristics are at least one of:

tessitura;
prosody;
dictionary built from phonemes;
phoneme order;
recording conditions.

The disclosure also concerns a device for separating an audio source from an audio signal comprising a mix of a background component and a speech component, comprising the following means: a speech example producing means for producing of a speech example relating to a speech component in said audio signal; a characteristics estimation means for estimating of a first set of characteristics of the audio signal and a second set of characteristics of the produced speech example; a separation means for separating the speech component of the audio signal by filtering of the audio signal using the estimated characteristics estimated by the characteristics estimation means, to obtain an estimated speech component and an estimated background component of the audio signal.

According to a variant embodiment of the device according to the disclosure, the device further comprises division means for dividing the audio signal and the speech example in blocks, where each block represents a spectral characteristic of the audio signal and of the speech example.

4. LIST OF FIGURES

More advantages of the disclosure will appear through the description of particular, non-restricting embodiments of the disclosure.

The embodiments will be described with reference to the following figures.

5. DETAILED DESCRIPTION

One of the objectives of the present disclosure is the separation of speech signals from a background audio in single channel or multiple channel mixtures such as a movie audio track. For simplicity of explanation of the features of the present disclosure, the description hereafter concentrates on single-channel case. The skilled person can easily extend the algorithm to multichannel case where the spatial model accounting for the spatial locations of the sources are added. The background audio component of the mixture comprises for example music, background speech, background noise, etc). The disclosure presents a workflow and an example algorithm where available textual information associated with the speech signal comprised in the mixture is used as auxiliary information to guide the source separation. Given the associated textual information, a sound that mimics the speech in the mixture (hereinafter referred to as the "speech example") is generated via, for example, a speech synthesizer or a human speaker. The mimicked sound is then time-synchronized with the mixture and incorporated in an NMF (Non-negative Matrix Factorization) based source separation system. State of the art source separation has been previously briefly discussed. Many approaches use a PLCA (Probabilistic Latent Component Analysis) modeling framework or Gaussian Mixture Model (GMM), which is however less flexible for an investigation of a deep structure of a sound source compared to the NMF model. Prior art also takes into account a possibility for manual annotation of source activity, i.e. to indicate when each source is active in a given time-frequency region of a spectrum. However, such prior-art manual annotation is difficult and time-consuming.

The disclosure also concerns a new NMF based signal modeling technique that is referred to as Non-negative Matrix Partial Co-Factorization or NMPCF that can handle a structure of audio sources and recording conditions. A corresponding parameter estimation algorithm that jointly handles the audio mixture and the generated guide source (the speech example) is also disclosed.

Figure 1:
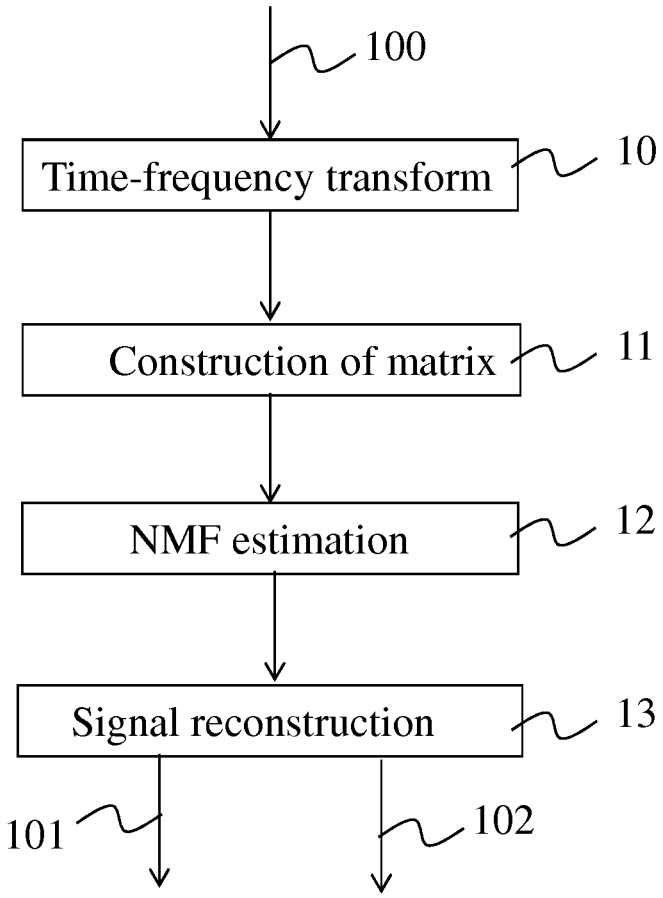
FIG. 1 is a workflow of an example state-of-the-art NMF based source separation system.

FIG. 1 is a workflow of an example state of the art NMF based source separation system. The input is an audio mix comprising a speech component mixed with other audio sources. The system computes a spectrogram of the audio mix and estimates a predefined model that is used to perform source separation. In a first step 10, the audio mix 100 is transformed into a time-frequency representation by means of an STFT (Short Time Fourier Transform). In a step 11 a matrix V is constructed from the magnitude or square magnitude of the STFT transformed audio mix. In a step 12, the matrix V is factorized using NMF. In a step 13, the audio signals present in the audio mix are reconstructed based on the parameters output from the NMF matrix factorization, resulting in an estimated speech component 101 and an estimated "background" component. The reconstruction is for example done by Wiener filtering, which is a known signal processing technique.

Figure 2:
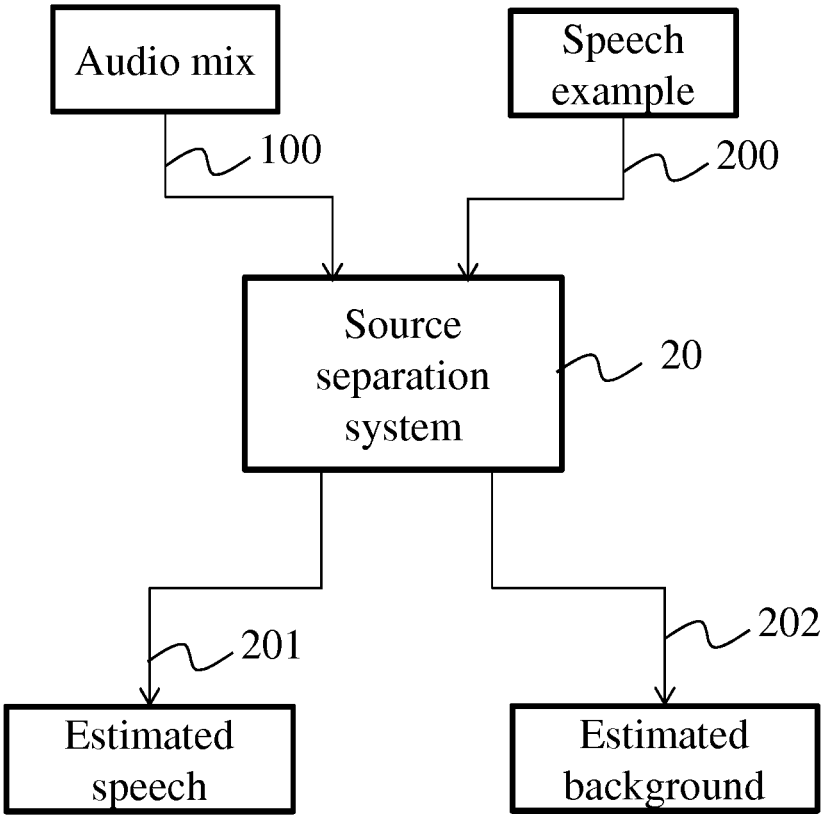
FIG. 2 is a global workflow of a source separation system according to the disclosure.

FIG. 2 is a global workflow of a source separation method according to the disclosure. The workflow takes two inputs: the audio mixture 100, and a speech example that serves as a guide source for the audio source separation. The output of the system is estimated speech 201 and estimated background 202.

Figure 3:
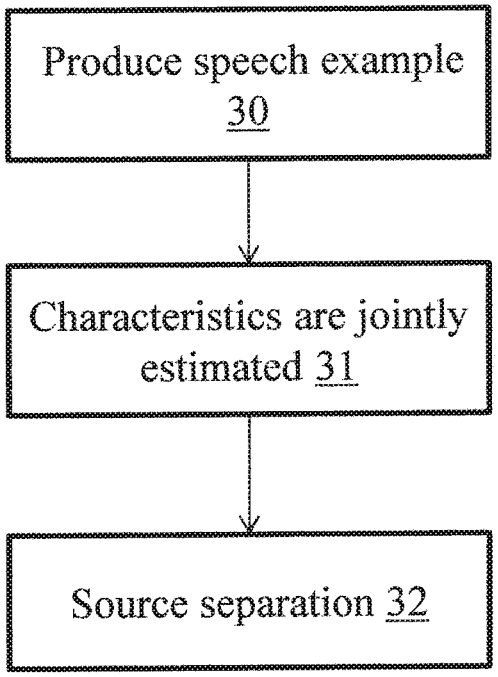
FIG. 3 is a flow chart of the source separation method according to the disclosure.

FIG. 3 is a flow chart of the source separation method according to the disclosure. In a first step 30, a speech example is produced, for example according to the previous discussed preferred method, or according to one of the discussed variants. Inputs of a second step 31 are the audio mixture and the produced speech example. In this step, characteristics of both are estimated that are useful for the source separation. Then, the audio mixture and the produced speech example (the guide source) are modeled by blocks that have common characteristics. Characteristics for a block are defined for example as spectral characteristics of the speech example, each characteristic corresponding to a block:

- tessitura (range of pitches)
- prosody (intonation)
- phonemes (a set of phonemes pronounced)
- phoneme order
- recording conditions.

Characteristics f of the audio mixture comprise:

- as above for speech example
- background spectral dictionary
- background temporal activations The blocks are matrices comprised of information about the audio signal, each matrix (or block) containing information about a specific characteristic of the audio signal e.g. intonation, tessitura, phoneme spectral envelopes. Each block models one spectral characteristic of the signal. Then these "blocks" are estimated jointly in the so-called NMPCF framework described in the disclosure. Once they are estimated, they are used to compute the estimated sources.

From the combination of both, the time-frequency variations between the speech example and the speech component in the audio mixture can be modeled.

In the following, a model will be introduced where the speech example shares linguistic characteristics with the audio mixture, such as tessitura, dictionary of phonemes, and phonemes order. The speech example is related to the mixture so that the speech example can serve as a guide during the separation process. In this step 31, the characteristics are jointly estimated, through a combination of NMF and source filter modeling on the spectrograms. In a third step 32, a source separation is done using the characteristics obtained in the second step, thereby obtaining estimated speech and estimated background, classically through Wiener filtering.

Figure 4:
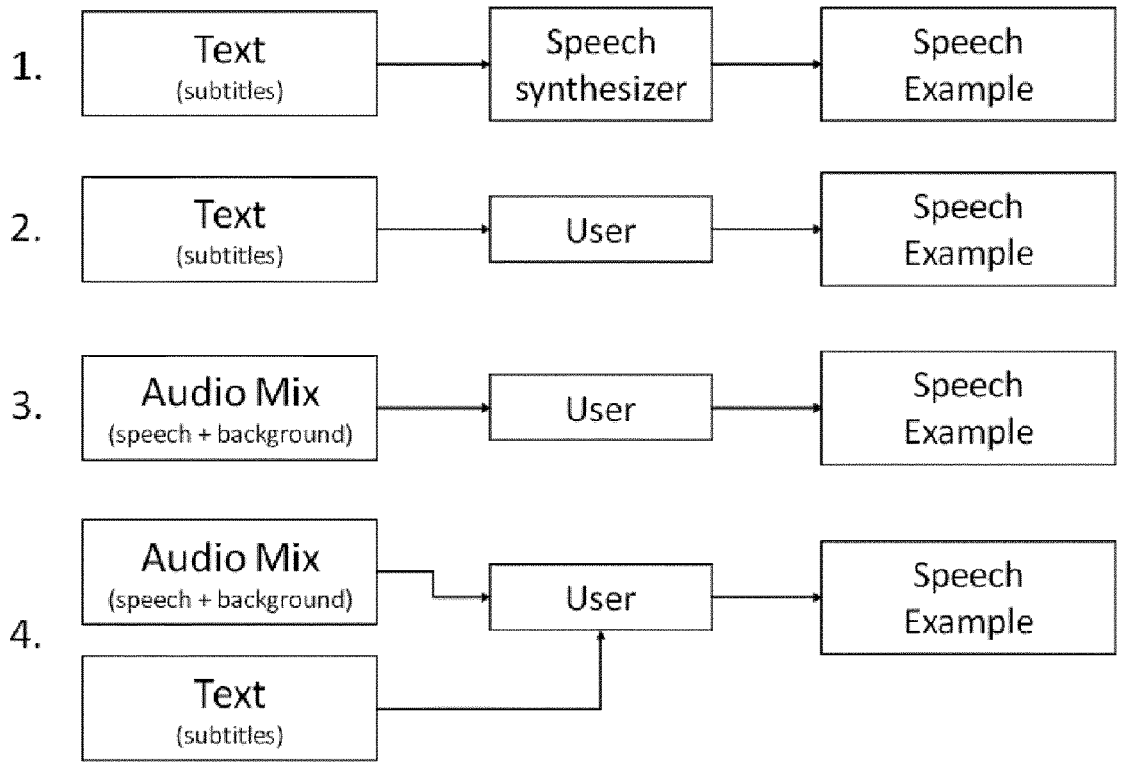
FIG. 4 illustrates some different ways to generate the speech example that is used as a guide source according to the disclosure.

FIG. 4 illustrates some different ways to generate the speech example that is used as a guide source according to the disclosure. A first, preferred generation method is fully automatic and is based on use of subtitles or movie script to generate the speech example using a speech synthesizer. Other variants 2 to 4 each require some user intervention. According variant embodiment 2, a human reads and pronounces the subtitles to produce the speech example. According variant embodiment 3 a human listens to the audio mixture and mimics spoken words to produce the speech example. According to variant embodiment 4, a human uses both subtitles and audio mixture to produce the speech example. Any of the preceding variants can be combined to form a particular advantageous variant embodiment in where the speech example obtains a high quality, for example through a computer-assisted process in which the speech example produced by the preferred method is reviewed by a human, listening to the generated speech example to correct and complete it.

Figure 5:
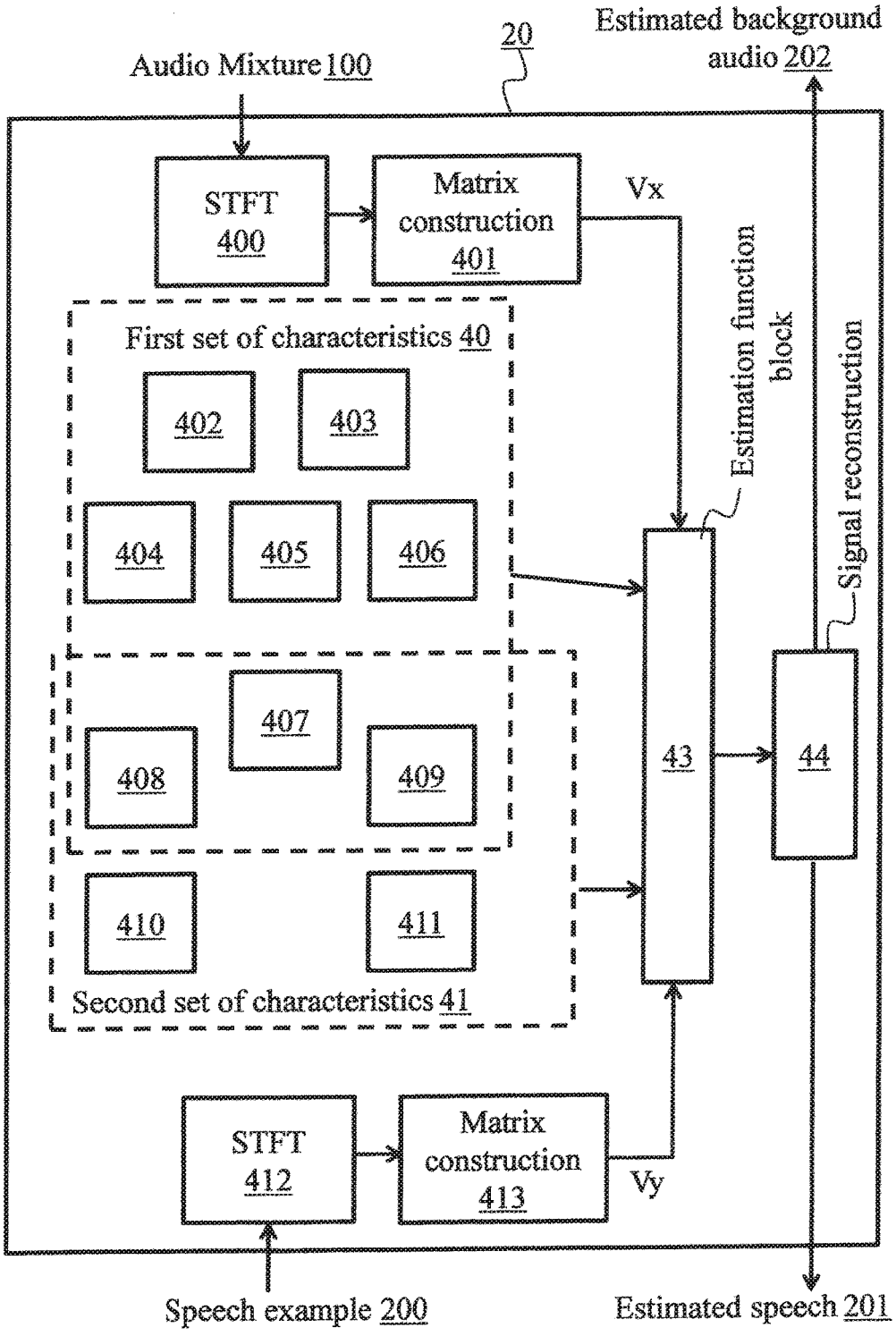
FIG. 5 is a further detail of an NMF based speech based audio separation arrangement according to the disclosure.

FIG. 5 is a further detail of an NMF based speech based audio separation arrangement according to the disclosure, as depicted in FIG. 2. The source separation system is the outer block 20. As inputs, the source separation system 20 receives an audio mix 100 and a speech example 200. The source separation system produces as output, estimated speech 201 and estimated background 202. Each of the input sources is time-frequency converted by means of an STFT function (by block 400 for the audio mix; by block 412 for the speech example) and then respective matrixes are constructed (by block 401 for the audio mix; by block 413 for the speech example). Each matrix (Vx for the audio mix, Vy for the speech example, the matrices representing time-frequency distribution of the input source signal) is input into a parameter estimation function block 43. The parameter estimation function block also receives as input the characteristics that were discussed under FIG. 3: from a first set 40 of characteristics of the audio mixture, and from a second set 41 of characteristics of the speech example. The first set 40 comprises characteristics 402 related to synchronization between the audio mix and the speech example (i.e. in practice, the audio mix and the speech example do not share exactly the same temporal dynamic); characteristics 403 related to the recording conditions of the audio mix (e.g. background noise level, microphone imperfections, spectral shape of the microphone distortion); characteristics 404 related to prosody (=intonation) of the audio mix; a spectral dictionary 405 of the audio mix; and characteristics 406 of temporal activations of the audio mix. The second set 41 comprises characteristics 410 related to the prosody of the speech example, and characteristics 411 related to the recording conditions of the speech example. The first set 40 and the second set 41, share some common characteristics, which comprise characteristics 408 related to tessitura; a dictionary of phonemes 407; and characteristics related to the order of phonemes 409. The common characteristics are supposed to be shared because it is supposed that the speech present in both input sources (the audio mixture 100 and in the speech example 200) share the same tessitura (i.e. the range of pitches of the human voice); they contain the same utterances, thus the same phonemes; the phonemes are pronounced in the same order. It is further supposed that the first set and the second set are distinct in the characteristics of prosody (=intonation; 404 for the first set, 410 for the second set); however, they differ in recording conditions (403 for the first set, 411 for the second set); and the audio mixture and the speech example are not synchronized (402). Both sets of characteristics are input into the estimation function block 43, that also receives the matrixes Vx and Vy representing the spectral amplitudes or power of the input sources (audio mix and speech example). Based on the sets of characteristics, the estimation function 43 estimates parameters that serve to configure a signal reconstruction function 44. The signal reconstruction function 44 then outputs the separated audio sources that were separated from the audio mixture 100, as estimated background audio 202 and estimated speech 201.

The previous discussed characteristics can be translated in mathematical terms by using an excitation-filter model of speech production combined with an NMPCF model, as described hereunder.

The excitation part of this model represents the tessitura and the prosody of speech such that:

- the tessitura 408 is modeled by a matrix $W_p^E$ in which each column is a harmonic spectral shape corresponding to a pitch;
- the prosody 404 and 410, representing temporal activations of the pitches, is modeled by a matrix whose rows represent temporal distributions of the corresponding pitches: denoted by $H_Y^E$ 410 for the speech example and $H_S^E$ 404 for the audio mix.

The filter part of the excitation-filter model of speech production represents the dictionary of phonemes and their temporal distribution such that:

- the dictionary of phonemes 407 is modeled by a matrix $W_Y^\Phi$ whose columns represent spectral shapes of phonemes;
- the temporal distribution of phonemes 409 is modeled by a matrix whose rows represent temporal distributions of the corresponding phonemes: $H_Y^\Phi$ for the example speech and $H_Y^\Phi D$ for the audio mix (as previously mentioned, the order of the phonemes is considered as being the same but the speech example and the audio mix are considered as not being perfectly synchronized).

For the recording conditions 403 and 411, a stationary filter is used: denoted by $w_Y$ 411 for the speech example and $w_S$ 403 for the audio mixture.

The background in the audio mixture is modeled by a matrix $W_B$ 405 of a dictionary of background spectral shapes and the corresponding matrix $H_B$ 406 representing temporal activations.

Finally, the temporal mismatch 402 between the speech example and the speech part of the mixture is modeled by a matrix D (that can be seen as a Dynamic Time Warping (DTW) matrix).

Figure 6:
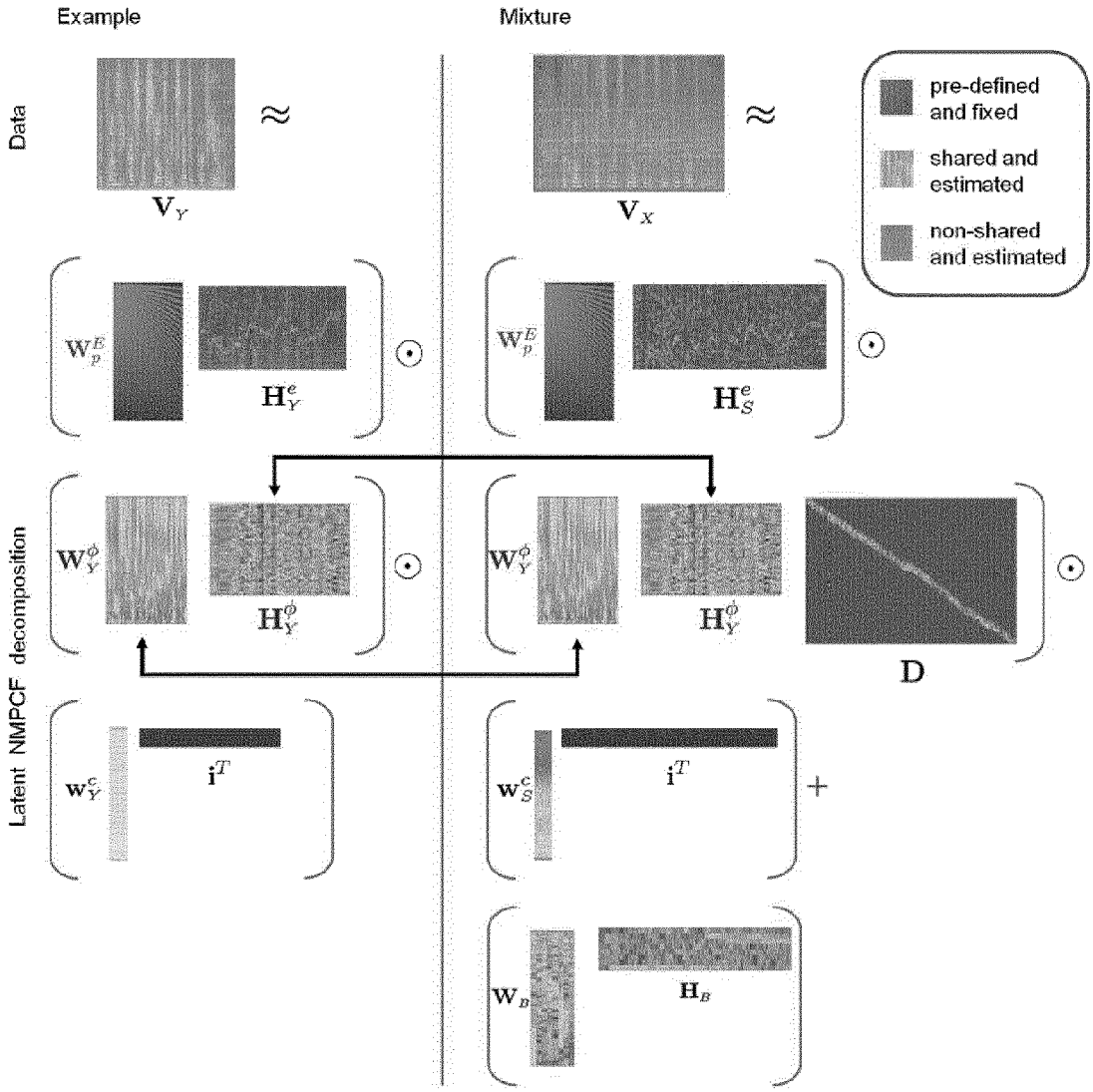
FIG. 6 is a diagram that summarizes the relations between the matrices of the model.

The two parts of the excitation-filter model of speech production can then be summarized by these two equations:

$$V_Y \simeq \hat{V}_Y = (W_p^E H_Y^E) \odot (W_Y^\phi H_Y^\phi) \odot (w_Y i^T) \tag{1}$$

$$V_X \simeq \hat{V}_X = \underbrace{(W_p^E H_S^E)}_{excitation} \odot \underbrace{(W_Y^\phi H_Y^\phi D)}_{filter} \odot \underbrace{(w_S i^T)}_{channel\ filter} + \underbrace{W_B H_B}_{background}$$

Where $\odot$ denotes the entry-wise product (Hadamard) and i is a column vector whose entries are one when the recording condition is unchanged. FIG. 6 is a diagram illustrating the above equation. It summarizes the relations between the matrices of the model. It is indicated which matrices are predefined and fixed ($W_p^E$ and $i^T$), which are shared (between the example speech and the audio mixture) and estimated ($W_Y^\Phi$, $H_Y^\Phi$), and which not shared and estimated (all other matrixes except Vx and Vy, which are input spectrograms. In the figure, "Example" stands for the speech example.

Parameter estimation can be derived according to either Multiplicative Update (MU) or Expectation Maximization (EM) algorithms. A hereafter described example embodiment is based on a derived MU parameter estimation algorithm where the Itakura-Saito divergence between spectrograms $V_Y$ and $V_X$ and their estimates $\hat{V}_Y$ and $\hat{V}_X$ is minimized (in order to get the best approximation of the characteristics) by a so-called cost function (CF):

$$CF = d_{IS}(V_Y|\hat{V}_Y) + d_{IS}(V_X|\hat{V}_X)$$

where $$d_{IS}(x|y) = \frac{x}{y} - \log\frac{x}{y} - 1$$

is the Itakura-Saito ("IS") divergence.

Note that a possible constraint over the matrices $W_Y^{\Phi}$, $w_Y$ and $w_S$ can be set to allow only smooth spectral shapes in these matrices. This constraint takes the form of a factorization of the matrices by a matrix Pthat contains elementary smooth shapes (blobs), such that:

$$W_Y^{\Phi}=PE^{\Phi}, w_Y=Pe_Y, w_S=Pe_S$$

where P is a matrix of frequency blobs, $E^{\Phi}$, $e_Y$ and $e_S$ are encodings used to construct $W_Y^{\Phi}$, $w_Y$ and $w_S$, respectively.

In order to minimize the cost function CF, its gradient is cancelled out. To do so its gradient is computed with respect to each parameter and the derived multiplicative update (MU) rules are finally as follows.

To obtain the prosody characteristic 410 $H_Y^E$ for the speech example:

$$H_Y^E \leftarrow H_Y^E \odot \frac{W_Y^{E^T}\left[\left(W_Y^{\phi}H_Y^{\phi}\right)\odot(w_Y i^T)\odot \hat{V}_Y^{\cdot[-2]}\odot V_Y\right]}{W_Y^{E^T}\left[\left(W_Y^{\phi}H_Y^{\phi}\right)\odot(w_Y i^T)\odot \hat{V}_Y^{\cdot[-1]}\right]} \tag{2}$$

To obtain the prosody characteristic 404 $H_S^E$ for the audio mix:

$$H_S^E \leftarrow H_S^E \odot \frac{W_S^{E^T}\left[\left(W_S^{\phi}H_S^{\phi}\right)\odot(w_S i^T)\odot \hat{V}_X^{\cdot[-2]}\odot V_X\right]}{W_S^{E^T}\left[\left(W_S^{\phi}H_S^{\phi}\right)\odot(w_S i^T)\odot \hat{V}_X^{\cdot[-1]}\right]} \tag{3}$$

To obtain the dictionary of phonemes $W_Y^{\Phi}=PE^{\Phi}$:

$$E^{\phi} \leftarrow E^{\phi} \odot \frac{P^{\phi T}\left[\left((W_Y^E H_Y^E)\odot(w_Y i^T)\odot \hat{V}_Y^{\cdot[-2]}\odot V_Y\right)H_Y^{\phi T} + \left((W_S^E H_S^E)\odot(w_S i^T)\odot \hat{V}_X^{\cdot[-2]}\odot V_X\right)H_S^{\phi T}\right]}{P^{\phi T}\left[\left((W_Y^E H_Y^E)\odot(w_Y i^T)\odot \hat{V}_Y^{\cdot[-1]}\right)H_Y^{\phi T} + \left((W_S^E H_S^E)\odot(w_S i^T)\odot \hat{V}_X^{\cdot[-1]}\right)H_S^{\phi T}\right]} \tag{4}$$

To obtain the characteristic 409 of the temporal distribution of phonemes $H_Y^{\Phi}$ of the example speech:

$$H_Y^{\phi} \leftarrow H_Y^{\phi} \odot \frac{W_Y^{\phi T}\left((W_Y^E H_Y^E)\odot(w_Y i^T)\odot \hat{V}_Y^{\cdot[-2]}\odot V_Y\right) + W_S^{\phi T}\left((W_S^E H_S^E)\odot(w_S i^T)\odot \hat{V}_X^{\cdot[-2]}\odot V_X\right)D^T}{W_Y^{\phi T}\left((W_Y^E H_Y^E)\odot(w_Y i^T)\odot \hat{V}_Y^{\cdot[-1]}\right) + W_S^{\phi T}\left((W_S^E H_S^E)\odot(w_S i^T)\odot \hat{V}_X^{\cdot[-1]}\right)D^T} \tag{5}$$

To obtain characteristic D 402, the synchronization matrix of synchronization between the speech example and the audio mix:

$$D \leftarrow D \odot \frac{H_Y^{\phi T} W_S^{\phi T}\left[(W_S^E H_S^E)\odot(w_S i^T)\odot \hat{V}_X^{\cdot[-2]}\odot V_X\right]}{H_Y^{\phi T} W_S^{\phi T}\left[(W_S^E H_S^E)\odot(w_S i^T)\odot \hat{V}_X^{\cdot[-1]}\right]} \tag{6}$$

To obtain the example channel filter $w_Y=Pe_Y$:

$$e_Y \leftarrow e_Y \odot \frac{P_Y^T\left[(W_Y^E H_Y^E)\odot\left(W_Y^{\phi}H_Y^{\phi}\right)\odot \hat{V}_Y^{\cdot[-2]}\odot V_Y\right]i}{P_Y^T\left[(W_Y^E H_Y^E)\odot\left(W_Y^{\phi}H_Y^{\phi}\right)\odot \hat{V}_Y^{\cdot[-1]}\right]i} \tag{7}$$

To the mixture channel filter $w_S=Pe_S$:

$$e_S \leftarrow e_S \odot \frac{P_S^T\left[(W_S^E H_S^E)\odot\left(W_S^{\phi}H_S^{\phi}\right)\odot \hat{V}_X^{\cdot[-2]}\odot V_X\right]i}{P_S^T\left[(W_S^E H_S^E)\odot\left(W_S^{\phi}H_S^{\phi}\right)\cdot \hat{V}_X^{\cdot[-1]}\right]i} \tag{8}$$

To obtain characteristic $H_B$ 406 representing temporal activations of the background in the audio mix:

$$H_B \leftarrow H_B \odot \frac{W_B^T\left(\hat{V}_X^{\cdot[-2]}\odot V_X\right)}{W_B^T\left(\hat{V}_X^{\cdot[-1]}\right)} \tag{9}$$

To obtain characteristic $W_B$ 405 of a dictionary of background spectral shapes of the background in the audio mix:

$$W_B \leftarrow W_B \odot \frac{\left(\hat{V}_X^{\cdot[-2]}\odot V_X\right)H_B^T}{\left(\hat{V}_X^{\cdot[-1]}\right)H_B^T} \tag{10}$$

Then, once the model parameters are estimated (i.e. via the above mentioned equations), the STFT of the speech component in the audio mix can be reconstructed in the reconstruction function 44 via a well-known Wiener filtering:

$$\hat{S}_{,ft} = \frac{\hat{V}_{S,ft}}{\hat{V}_{S,ft}+\hat{V}_{B,ft}} \times X_{,ft} \tag{11}$$

Where $A_{,ij}$ is the entry value of matrix A at row i and column j, X is the STFT of the mixture, $\hat{V}_S$ is the speech related part of $\hat{V}_X$ and $\hat{V}_B$ its background related part.

Thereby obtaining the estimated speech component 201. The STFT of the estimated background audio component 202 is then obtained by:

$$\hat{B}_{,ft} = \frac{\hat{V}_{B,ft}}{\hat{V}_{S,ft}+\hat{V}_{B,ft}} \times X_{,ft} \tag{12}$$

A program for estimating the parameters can have the following structure:

```
Compute V_Y and V_X;// compute the spectrograms of the
    // example Vx and of the
    // mixture Vy
Initialize V̂_Y and V̂_X;      // and all the parameters
                             // constituting them according
                             // to (1)
For step 1 to N; // iteratively update params
  Update parameters constituting V̂_Y and V̂_X;
  // according to (2) ,..., (10)
```

-continued

End for;
Wiener filtering audio mixture based on params comprised in $\hat{V}_Y$ and $\hat{V}_X$; // according to (11) and (12);
Output separate sources.

Figure 7:
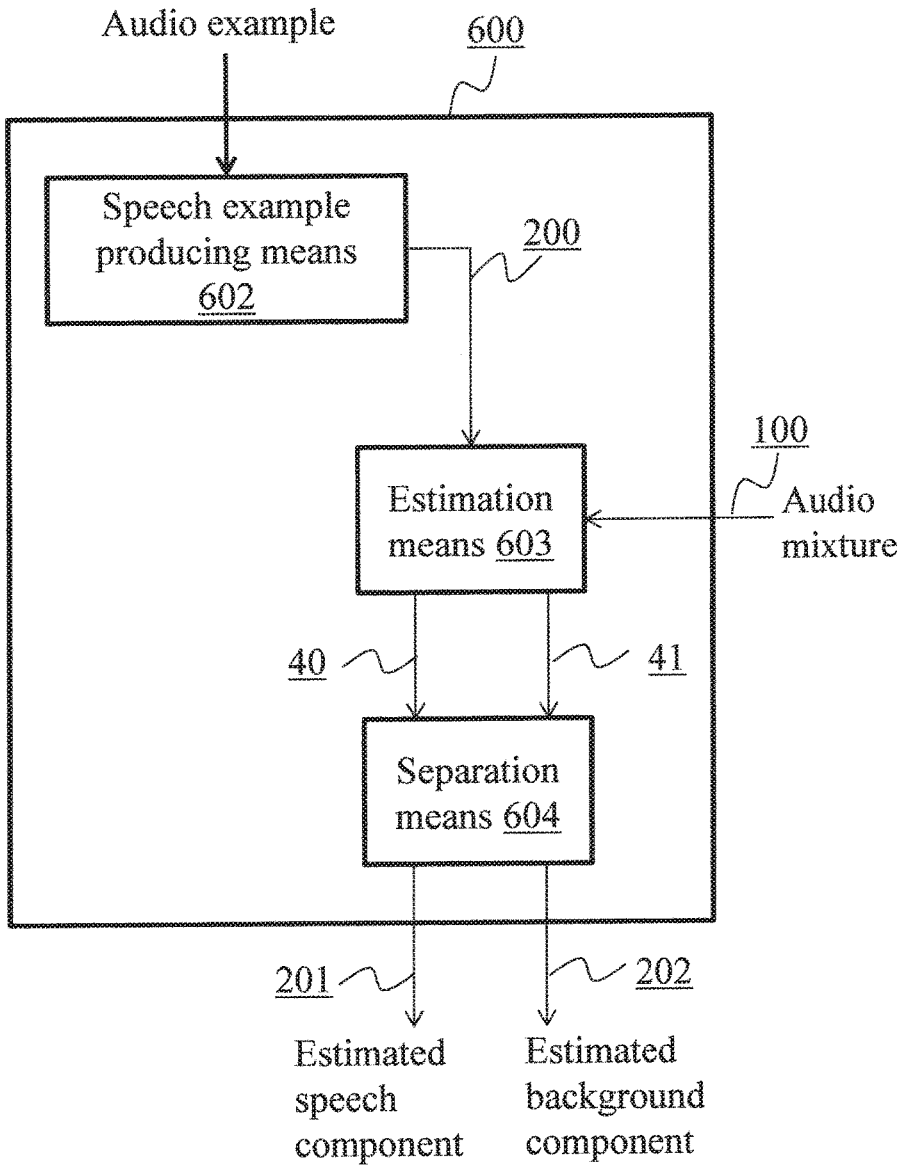
FIG. 7 is a device 600 that can be used to implement the method of separating audio sources from an audio signal according to the disclosure.

FIG. 7 is a device 600 that can be used to the method of separating audio sources from an audio signal according to the disclosure, the audio signal comprising a mix of a background component and a speech component. The device comprises a speech example producing means 602 for producing of a speech example from information 600 relating to a speech component in the audio signal 100. The output 200 of the speech example producing means is fed to a characteristics estimation means (603) for estimating of a first set of characteristics (40) of the audio signal and a second set of characteristics (41) of the produced speech example, and separation means (604) for separating the speech component of the audio signal by filtering of the audio signal using the estimated characteristics estimated by the characteristics estimation means, to obtain an estimated speech component (201) and an estimated background component (202) of the audio signal. Optionally, the device comprises dividing means (not shown) for dividing the audio signal and the speech example in blocks representing parts of the audio signal and of the speech example having common characteristics.

As will be appreciated by one skilled in the art, aspects of the present principles can be embodied as a system, method or computer readable medium. Accordingly, aspects of the present principles can take the form of an entirely hardware embodiment, en entirely software embodiment (including firmware, resident software, micro-code and so forth), or an embodiment combining hardware and software aspects that can all generally be defined to herein as a "circuit", "module" or "system". Furthermore, aspects of the present principles can take the form of a computer readable storage medium. Any combination of one or more computer readable storage medium(s) can be utilized.

Thus, for example, it will be appreciated by those skilled in the art that the diagrams presented herein represent conceptual views of illustrative system components and/or circuitry embodying the principles of the present disclosure. Similarly, it will be appreciated that any flow charts, flow diagrams, state transition diagrams, pseudo code, and the like represent various processes which may be substantially represented in computer readable storage media and so executed by a computer or processor, whether or not such computer or processor is explicitly shown.

A computer readable storage medium can take the form of a computer readable program product embodied in one or more computer readable medium(s) and having computer readable program code embodied thereon that is executable by a computer. A computer readable storage medium as used herein is considered a non-transitory storage medium given the inherent capability to store the information therein as well as the inherent capability to provide retrieval of the information there from. A computer readable storage medium can be, for example, but is not limited to, an electronic, magnetic, optical, electromagnetic, infrared, or semiconductor system, apparatus, or device, or any suitable combination of the foregoing. It is to be appreciated that the following, while providing more specific examples of computer readable storage mediums to which the present principles can be applied, is merely an illustrative and not exhaustive listing as is readily appreciated by one of ordinary skill in the art: a portable computer diskette; a hard disk; a read-only memory (ROM); an erasable programmable read-only memory (EPROM or Flash memory); a portable compact disc read-only memory (CD-ROM); an optical storage device; a magnetic storage device; or any suitable combination of the foregoing.

The invention claimed is:

1. A method of audio source separation from an audio signal comprising a mix of a background component and a speech component, wherein said method is based on a non-negative matrix partial co-factorization, the method comprising:

producing a speech example relating to a speech component in the audio signal;

converting said speech example and said audio signal to non-negative matrices representing their respective spectral amplitudes;

receiving a first set of characteristics of the audio signal and a second set of characteristics of the produced speech example;

estimating parameters for configuration of said separation, said received first set of characteristics and said received second set of characteristics being used for modeling mismatches between the speech example and the speech component, said mismatches comprising a temporal synchronization mismatch, a pitch mismatch and a recording conditions mismatch;

obtaining an estimated speech component and an estimated background component of the audio signal by separation of the speech component from the audio signal through filtering of the audio signal using the estimated parameters;

the first and the second set of received characteristics being at least one of a tessiture, a prosody, a dictionary built from phonemes, a phoneme order, or recording conditions.

2. The method according to claim 1, wherein said speech example is produced by a speech synthesizer.

3. The method according to claim 2, wherein said speech synthesizer receives as input subtitles that are related to said audio signal.

4. The method according to claim 2, wherein said speech synthesizer receives as input at least a part of a movie script related to the audio signal.

5. The method according to claim 1, further comprising a dividing the audio signal and the speech example into blocks, each block representing a spectral characteristic of the audio signal and of the speech example.

6. A device for separating, through non-negative matrix partial co-factorization, audio sources from an audio signal comprising a mix of a background component and a speech component, comprising:

a speech example producer configured to produce a speech example relating to a speech component in said audio signal;

a converter configured to convert said speech example and said audio signal to non-negative matrices representing their respective spectral amplitudes;

a parameter estimator configured to estimate parameters for configuring said separating by a separator, said parameter estimator receiving a first set of characteristics of the audio signal and a second set of characteristics of the produced speech example, wherein said first set of characteristics and said second set of characteristics serve for modeling by said parameter estimator mismatches between the speech example and the speech component, said mismatches comprising a temporal synchronization mismatch, a pitch mismatch and a recording conditions mismatch;

the separator being configured to separate the speech component of the audio signal by filtering of the audio signal using said parameters estimated by the parameter estimator, to obtain an estimated speech component and an estimated background component of the audio signal;

the first and the second set of received characteristics being at least one of a tessiture, a prosody, a dictionary built from phonemes, a phoneme order, or recording conditions, the synchronization mismatch between the speech example and the speech component being at least one of a temporal mismatch between the speech example and the speech component, a mismatch between distributions of phonemes between the speech example and the speech component, a mismatch between a distribution of pitch between the speech example and the speech component, or a recording conditions mismatch between the speech example and the speech component.

7. The device according to claim 6, further comprising a divider configured to divide the audio signal and the speech example in blocks of a spectral characteristic of the audio signal and of the speech example.

8. The device according to claim 6, further comprising a speech synthesizer configured to produce said speech example.

9. The device according to claim 8, wherein said speech synthesizer is further configured to receive as input subtitles that are related to the audio signal.

10. The device according to claim 8, wherein said speech synthesizer is further configured to receive as input at least a part of a movie script related to the audio signal.

* * * * *